US005178306A

United States Patent [19]

Petrou

[11] Patent Number: 5,178,306

[45] Date of Patent: Jan. 12, 1993

[54] HANGER WITH CLIPS

[76] Inventor: Nicoleon Petrou, 1531 W. Tadmar Ave., Anaheim, Calif. 92802

[21] Appl. No.: 834,884

[22] Filed: Feb. 11, 1992

[51] Int. Cl.[5] ..... A47G 25/48

[52] U.S. Cl. ..... 223/96; 24/477; 24/487; 24/528; 223/91

[58] Field of Search ..... 223/85, 91, 93, 90, 223/96; 24/477, 487, 522, 528; D6/326, 325, 323

[56] References Cited

U.S. PATENT DOCUMENTS

| | | | |
|---|---|---|---|
| 1,276,145 | 8/1918 | White | 24/477 |
| 2,337,723 | 12/1943 | Levin . | |
| 2,403,639 | 7/1946 | Cohen . | |
| 3,405,429 | 10/1968 | Vazquez . | |
| 3,665,563 | 5/1972 | Batts . | |
| 3,698,043 | 10/1972 | Batts . | |
| 3,698,607 | 10/1972 | Batts . | |
| 3,745,616 | 7/1973 | Batts . | |
| 3,823,855 | 7/1974 | Dohring . | |
| 4,157,782 | 6/1979 | Mainetti . | |
| 4,209,879 | 7/1980 | Paajanen . | |
| 4,231,500 | 11/1980 | Mainetti . | |
| 4,438,874 | 3/1984 | Zuckerman et al. | 223/93 X |
| 4,763,390 | 8/1988 | Rooz | 223/93 X |
| 5,027,480 | 7/1991 | Hogarth | 24/487 |

FOREIGN PATENT DOCUMENTS

| | | | |
|---|---|---|---|
| 2018883 | 10/1979 | United Kingdom | 24/487 |
| 2044096 | 10/1980 | United Kingdom . | |

*Primary Examiner*—Werner H. Schroeder
*Assistant Examiner*—Bibho Mohanty
*Attorney, Agent, or Firm*—Blakely, Sokoloff, Taylor, Zafman

[57] ABSTRACT

A plastic hanger having clips located at opposite ends of the hanger is described. Each clip comprises grip plates hingedly joined to each other, which grip plates can be forced together to clamp a garment therebetween. To generate the clamping action of the grip plates, the hanger provides cuneiform members formed on the grip plate that can be wedged into an angular recess to close the grip plates together. Teeth are provided on the cuneiform members and along an interior surface of the angular recess to lock the two together and hold the cuneiform member deeply wedged inside the angular recess. Pushing down on the grip plate takes the teeth out of engagement, and accordingly, the cuneiform member can be unwedged and retracted from the angular recess to release the garment. As an option, thumb rests can be added to the grip plates for better leverage. Stubbles can be incorporated into contact surfaces of the grip plates for more contact with the garment.

12 Claims, 2 Drawing Sheets

FIG. 1
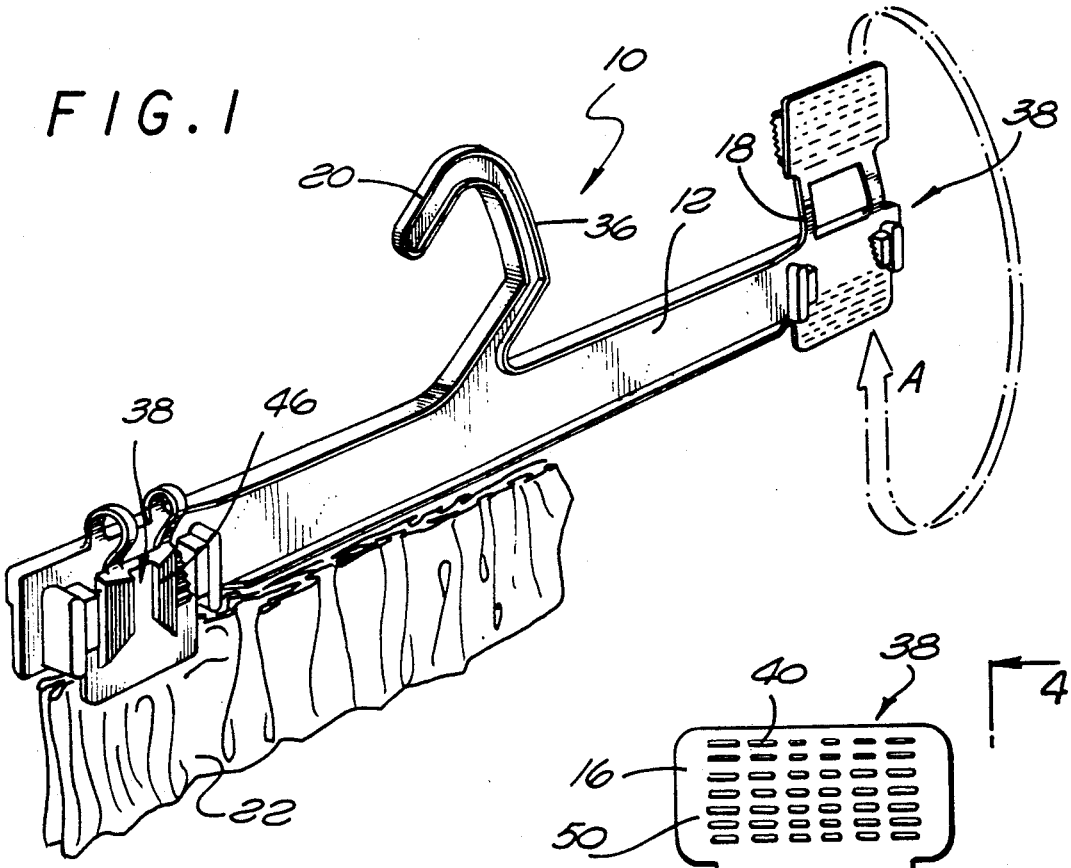
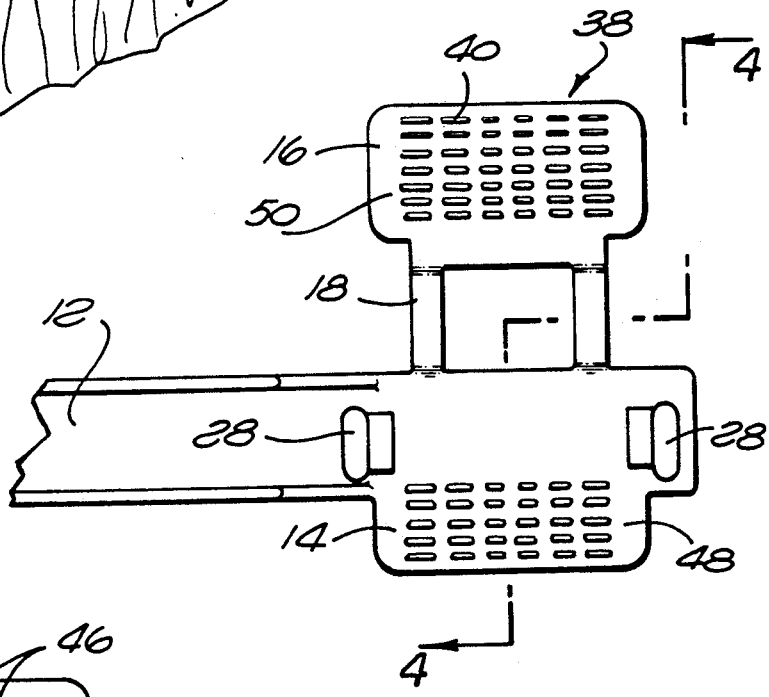
FIG. 2
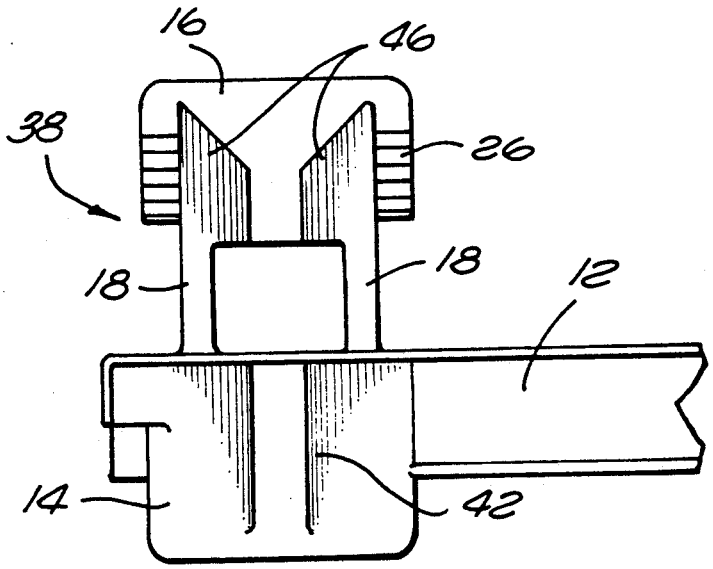
FIG. 3

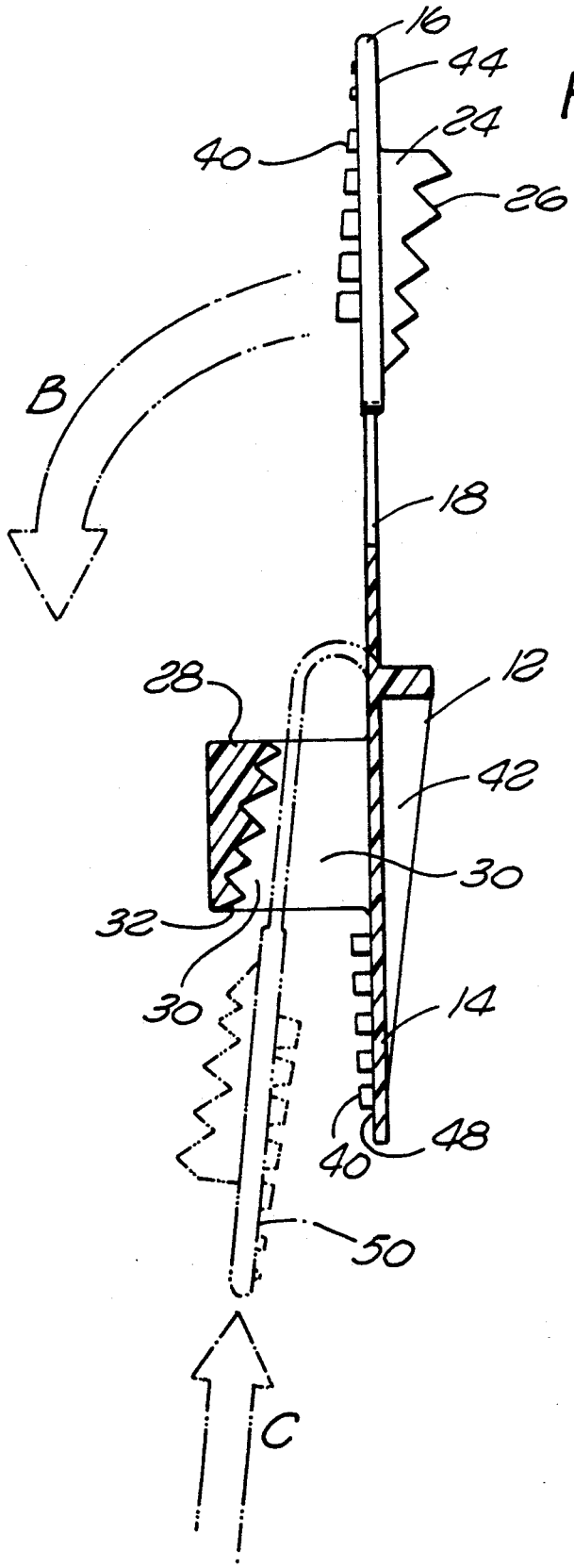
FIG. 4
FIG. 5
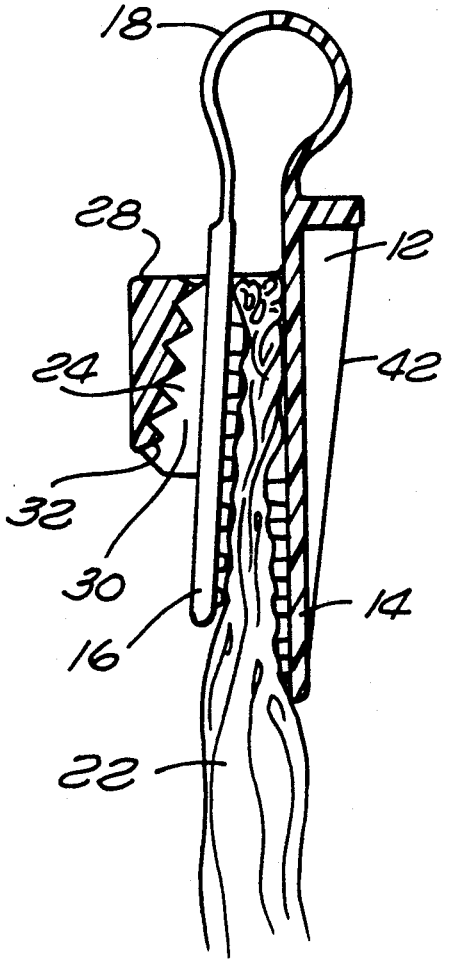

HANGER WITH CLIPS

BACKGROUND OF THE INVENTION

1. Field of the Invention

The present invention relates to clothing or garment hangers. More precisely, the present invention relates to a clothing hanger having garment clips to capture and retain an article of clothing.

2. Description of the Prior Art and Related Information

Most everyone is familiar with the conventional wire-frame clothing hanger. It is fabricated from a single cord of wire bent into a triangular shape with sloping arms and a crossbar, and topped off at the top by a hook. This simple hanger is adequate for suspending shirts or jackets, but often has shortcomings when used to hang a skirt, or trousers. Often times, the weight of the skirt or trousers when draped over the crossbar causes the crossbar to sag, thus leading to wrinkled clothing. Also, the clothing tends to slide off of the crossbar. Further, for shipping and merchandising the clothing, its handling and display require hangers which securely retain the clothing on the hanger.

There have been many mechanical modifications to the conventional hanger in an attempt to secure the garment to the hanger. This application is particularly important in the garment industry where garments are shipped to retailers on hangers, removed from the hangers and placed on better quality display hangers, and where shoppers must remove on the article of clothing from the hanger before purchasing. Thus, as the garment hangs in a store rack, it must endure numerous cycles of removal from and re-hanging on the hanger.

Moreover, as seen in numerous department stores and discount stores, garments are frequently moved from one rack to another, or shuffled about as they are suspended on the rack. Thus, the mechanism securing the garment to the hanger must be reliable. Yet the mechanism must also release the garment when necessary and be easy to re-attach. In view of the large quantity of clothing offered in a department store, the number of hangers used is necessarily great. As a result, the cost of each hanger must be low to meet economic constraints observed by all retail stores.

Various hangers have been devised at securing an article of clothing to the crossbar. For instance, a modified wire hanger has a tube that wraps around the crossbar and is coated with tacky glue. Ideally, the glue adheres to the article of clothing to prevent it from slipping off of the hanger. Also by reinforcing the crossbar with the tube, the sagging problem is corrected. Unfortunately, after a period of use, the tackiness of the glue diminishes. The tacky glue approach is thus not ideal for commercial use since the glue loses its adherence only after a few cycles.

A mechanical approach to retaining a garment on a hanger provides spring-loaded clips or clamps designed to pinch the garment to the crossbar. The clips can be separate from the hanger or, optionally, the clips can be secured to the crossbar so that during use in the store, they are not detached and misplaced. A drawback of this design is that the construction of the clips is relatively expensive. Specifically, metal clips made of spring steel are necessary to provide the resilient compliance or bias in the clips. Alternatively, the clips can be spring loaded using a coiled spring. In either case, material costs and assembly costs are high.

Another approach applies a plastic clip formed into a U-shape to pinch the garment against the crossbar. However, as is obvious, the clip can be easily separated from the hanger and lost.

In another conventional hanger, both ends of the crossbar have a downward protruding nib. Stretched across the nib is a rubber band. The rubber band holds the garment firmly against the crossbar. To remove the garment, one simply slides one end of the rubber band off a nib thereby releasing the garment. This approach, however, is a bit cumbersome and again the rubber band can get lost or separated from the hanger.

Yet another approach provides a crossbar that is forced against a stiff metal wire extending along the length of the crossbar and immediately adjacent thereto. One end of the crossbar can be snapped into or out of a loop formed in the wire. Thus, the crossbar can be pulled out of contact with the wire so that the garment can be hung thereon. The crossbar is then snapped back into the loop, locking the garment between the wire and the crossbar. Of course, this form of suspension is primarily directed to trousers and the like but is not particularly well adapted for skirts or dresses. The reason is that the skirt must be draped over the crossbar which, when locked into the wire, causes a crease in the skirt.

Accordingly, a need presently exists for a hanger that reliably secures a garment thereto and is inexpensive to fabricate.

SUMMARY OF THE INVENTION

The present invention relates to a hanger employing clips to secure a garment thereto. In a preferred embodiment, the present invention provides a hanger having a frame with a hook attached to an intermediate position. At opposite ends of the frame are clips, formed integrally with and hinged to the frame. The hinges permit the clips to rotate and move laterally away from and toward the frame. The clips have grip plates that pinch an article of clothing therebetween.

To maintain the pinch hold of the grip plates, small wedge-shaped members are formed into an exterior surface of the plates with a corresponding and mating wedge disposed on a receiving member. To keep the cuneiform members wedged into the recess, the preferred embodiment of the present invention provides teeth that lock into another row of teeth located in the receiving member.

To ensure a more positive contact with the article of clothing, the grip plates can be pushed farther into the recess, thus compressing the garment between the plates even more. Of course the amount of pinching pressure can be adjusted by how far forward the cuneiform member is wedged into the receiving member. Thumb rests are optionally provided on the grip plates for this purpose. Conversely, to release the grip, pushing downward on the thumb rests removes contact between the teeth, and the cuneiform members can be unwedged from the receiving member.

Thus, the present invention provides a hanger that can easily secure a garment thereto with a simple wedging action. Removal of the garment from the hanger is likewise simple and quick.

Furthermore, since the hanger can be injection molded from plastic in a single operation, without addition of springs or other parts, the entire cost for the hanger is lower than prior art hangers with clips. Because no springs need be assembled to the hanger, there are no assembly costs. The clips are also permanently molded into the frame so they cannot get lost during use.

In an alternative embodiment, the present invention provides a hanger with a frame comprising downward sloping arms and a crossbar, formed into a triangular shape. The grip plates and associated structures described above are in this embodiment disposed on the crossbar. In this manner, the invention is well adapted to hanging a woman's suit. Specifically, the skirt can be secured by the clips on the crossbar, while the jacket can be draped over the shoulders of the hanger.

To further improve grip of the grip plates on the garment, small stubbles are provided on the interior contact surfaces of the grip plates. Furthermore, the heights of the stubbles can be varied to produce an incline along each row. The higher stubbles, of course, supply a more positive engagement with the garment when the grip plates are closed together.

BRIEF DESCRIPTION OF THE DRAWINGS

FIG. 1 is a perspective view of a preferred embodiment hanger.

FIG. 2 is a partial view of the hanger detailing one clip.

FIG. 3 is a back view of the clip shown in FIG. 2.

FIG. 4 is a partial sectional view of the clip taken along line 4—4 of FIG. 2.

FIG. 5 is a partial sectional view of the clip as it clamps onto a garment.

DETAILED DESCRIPTION OF THE INVENTION

The following specification describes an improved hanger with clips. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

The present invention provides a one-piece garment hanger having clips disposed on opposite ends. Although the following discussion focuses on the use of the hanger with garments, it is clear that the hanger is adaptable to man other uses known in the art. The clips operate through a wedging action to lock the clamping plates together. Unwedging the locking structures releases the clips and frees the garment from the hanger.

FIG. 1 illustrates a preferred embodiment of the present invention. The drawing shows a hanger 10 from a perspective view. The hanger 10 has a frame 12 bisected by a hook 20, with clips 38 located at opposite ends of the frame 12.

The frame 12 has a ridge or lip 36 following the entire edge of the frame 12, which acts as reinforcement to resist bending or torsional forces on the frame 12. The frame 12 is made from a polymer, preferably a thermoplastic material capable of being injection molded. Various polymers known in the art are acceptable, including polypropylene, vinyl, or K-resin.

As seen in FIG. 1, attachment of the garment 22 to the frame 12 is accomplished by clamping the garment 22 with the clips 38. Arrow A indicates the motion of the clamping plates and the bend point or hinge portion 18 of the clip 38.

FIG. 2 provides a better view of one of the clips 38 in its open position. As seen here, the clip 38 is comprised of a first grip plate 14 and a second grip plate 16, connected by hinge portion 18. The benefit to the present invention is that the grip plates 14, 16 and the hinge portion 18 can be molded simultaneously as a single piece which is integral with the frame 12. With the grip plates 14, 16 open as shown, the stubbles 40 located on the contact surfaces 48, 50 of the grip plates 14, 16, respectively, can be seen.

FIG. 3 depicts the back side of the clip 38 shown in FIG. 2. The one-piece nature and simple construction of the clip 38 are depicted in this view. Along either side of the second grip plate 14 are teeth 26. The purpose of the teeth 26 are discussed below. Also, in the back of the first grip plate 14 is a brace 42. The brace 42 is simply an area of reinforced material extending perpendicular from the frame surface. The brace 42 is optionally included as a means of resisting torsional or bending forces exerted on the frame 12 and clip 38.

FIG. 4 is a sectional view of a single clip 38 taken along line 4—4 of FIG. 2. Arrow B designates the motion path of the second grip plate 16 as it moves from an open position to a closed or clamping position, shown here with phantom or dashed lines. In comparison, FIG. 5 illustrates the second grip plate 16 in its locked position, pinching a garment 22 between the grip plates 14, 16.

As seen in FIG. 4 and FIG. 2, the second grip plate 16 has an outer surface 44 facing away from first grip plate (14) and which has disposed thereon a cuneiform member 24. Along the surface of the cuneiform member 24 are teeth 26.

As the second grip plate 16 is pushed in the direction of Arrow B, and then along the direction of Arrow C, it moves into an overlying relationship relative to the first grip plate 14. Rising from the surface of the first grip plate 14 is a receiving member 28 having an angular recess 30 formed therein. There are two of the receiving members 28, one disposed on each side of the first grip plate 14. The angular recess 30, as its name implies, has a larger opening at one end and a smaller opening at the opposite end. Thus, as the cuneiform member 24 is pushed in direction C and enters the angular recess 30, the cuneiform member 24 eventually becomes wedged into the angular recess 30.

The farther the second grip plate 16 is pushed in direction C, the more the second grip plate 16 closes in on the first plate 14. The more the grip plates 14, 16 come together, the more positive the grip is on the garment 22. Hence, the pressure exerted on the garment 22 by the grip plates 14, 16 can be adjusted.

During the interim between the time when the second grip plate 16 is in the closed position of FIG. 4 and when the second grip plate 16 is in the locked position of FIG. 5, the garment 22 must be inserted between the contact surfaces 48 and 50 of the first grip plate 14 and second grip plate 16, respectively. As mentioned before, pushing the second grip plate 16 in direction C shown in FIG. 5 eventually wedges the cuneiform member 24 into the angular recess 30, illustrated in FIG. 5. This is the locked position in which the garment 22 is pinched between the first and second grip plates 14, 16.

The natural tendency is for the cuneiform member 24 to unwedge itself from the angular recess 30. Indeed, the weight of the garment 22 tends to pull the second grip plate 16 and the cuneiform member 24 downward and out of engagement with the receiving member 28. Therefore, to resist this tendency, the present invention provides teeth 32 along an interior surface of the receiving member, designed to engage the teeth 26 of the cuneiform member 24. Hence, in the locked position of FIG. 5, the resilience in the hinge portion 18 urging the second grip plate 16 to spring back to its initial vertical position along with the tendency for the garment 22 to expand after being compressed during the wedging action combine to force the second grip plate 16 outward and against an interior set of teeth 32 of the receiving member 28. To be sure, if the cuneiform member 24 is wedged into the angular recess 30 far enough and the garment 22 is compressed sufficiently to present an outward expansion force, the cuneiform member teeth 26 maintains positive contact against the interior teeth 32 of the receiving member 28.

To insure constant pressure across the contact surfaces 48, 50, the present invention provides two receiving members 28 disposed on opposite sides of the first grip plate 14 near the perimeter, as shown in FIG. 2. Accordingly, on each clip 38, one pair of cuneiform members 24 engage a respective pair of angular recesses 30 inside the receiving members 28.

Note that the angular recess 30 on the interior of the receiving member 28 is sloped, and as the name of the cuneiform member 24 suggests, its surface is also sloped. As seen in a profile view in FIG. 4, the two structures have a triangular cross-sections. Preferably, the smallest included angle on both parts should have a magnitude of about 15° for best performance. Indeed, the incline of the cuneiform member 24 should match the incline of the angular recess 30.

The value of the brace 42 is thus manifest, because the extra material stiffens the back side of the first grip plate 14. Certainly, the brace 42 adds strength along the height of the first grip plate 14 and prevents it from bending or flexing in the locked position.

Preferably, the thickness of the hinge portion 18 should be 0.017 inch. This provides sufficient material to ensure resiliency and spring back to urge the bent over second grip plate 16 back into its upright position. If too much material is provided in the hinge portion 18, it becomes difficult or impossible to bend the hinge portion.

The height of the stubbles increases gradually in one direction. The increasing height of the stubbles 40 permits more positive contact where needed toward the higher points of contact with the garment 22.

For more leverage, the present invention provides in a preferred embodiment thumb rests 46 shown in FIG. 3. The thumb rests 46 have a textured surface and jut outward to give a large pressure area.

To release the garment 22, one pushes down on the thumb rest 46 which moves the second grip plate 16 against the first grip plate 14, simultaneously disengaging the cuneiform member teeth 26 from the interior teeth 32. Then slightly downward pressure on the second grip plate 16 unwedges the cuneiform member 24 from the recess 30. Finally, once the edges of the second grip plate 16 are clear of the angular recess 30, the second grip plate 16 springs back to its initial upright position and releases the garment 22.

In an alternative embodiment (not shown), the present invention provides a hanger having sloping shoulders and a crossbar together forming a triangular shape. In this embodiment, the clips as described above are disposed on the crossbar. This embodiment is adapted for hanging multi-piece ensembles, such as women's suits. The skirt can be suspended by the clips and the sloping shoulders facilitates draping the jacket thereon.

Many other modifications to the present invention are possible. For example, the hook can be adapted to swivel on the frame. The number, shape, and size of the stubbles can be varied for optimum gripping. Further, the present invention hanger can be modified with loops, recesses, or hooks from which other clothing accouterments, such as ties or hats, can be hung.

Also, although the preferred embodiment employs a plurality of teeth on the cuneiform member and in the interior of the receiving member, other means for frictionally locking the two structures together can be used. For example, a simple tongue and groove can be used or a single tooth can be used to lock into a depressed area along the interior of the receiving member, etc.

I claim:

1. A clothes hanger comprising: a frame;
a hook disposed on the frame; and
at least one clamp including
a first grip plate integral with the frame,
a second grip plate having an outer surface facing away from the first grip plate, hingedly attached to the first grip plate,
a cuneiform member disposed on the outer surface,
a receiving member attached to the frame having an angular recess to receive the cuneiform member,
retaining means disposed on the cuneiform member to engage an interior surface of the recess,
whereby moving the cuneiform member into the angular recess aligns the first and second grip plates in an overlying relationship, closing the plates together.

2. A clothes hanger according to claim 1, wherein the retaining means is at least one tooth.

3. A clothes hanger according to claim 2, wherein the interior surface of the angular recess further comprises at least one tooth to engage at least one tooth of the cuneiform member.

4. A clothes hanger according to claim 3, wherein the first and second grip plates further comprises respective interior surfaces with stubbles.

5. A clothes hanger according to claim 4, wherein a thumb rest is disposed on the exterior surface of the second grip plate.

6. A clothes hanger of claim 2 wherein said retaining means and said angular recess each comprise a plurality of teeth.

7. A clothes hanger of claim 3 wherein said retaining means and said angular recess each comprise a plurality of teeth.

8. A clothes hanger according to claim 6, wherein the hanger is made from a polymer selected from the group consisting of polypropylene, vinyl, or resin.

9. A clothes hanger according to claim 7, wherein the cuneiform member retaining means includes an angle ranging from 10 to 20 degrees.

10. A clothes hanger according to claim 8, wherein an arched hinge interconnecting the first grip plate to the second grip plate has a thickness ranging from 0.010" to 0.020".

11. A clothes hanger according to claim 9, wherein the frame has sloping shoulders to support a garment draped thereon.

12. A clothes hanger for suspending a garment comprising:

a frame having opposite ends;

a hook joined to the frame; and two clamps disposed on opposite ends of the frame both clamps including a first grip plate integral with the frame, a second grip plate having an outer surface facing away from the first grip plate and a perimeter, a cuneiform member disposed on the outer surface on the perimeter of the second plate, wherein each cuneiform member has a plurality of teeth, a receiving members disposed adjacent first grip plate wherein receiving member has an angular recess with an interior surface having a plurality of teeth to engage the plurality of teeth of the cuneiform member, a thumb rest disposed on the outer surface of the second member, and interior contact surfaces on the first grip plate and the second grip plate having stubble thereon, whereby the cuneiform members are moved with the thumb rest into the angular recess and the teeth of the cuneiform members engage the teeth of the receiving members, causing the first grip plate to close together against the second grip plate and pinching the garment therebetween.

* * * * *